United States Patent [19]

Bixler et al.

[11] Patent Number: 5,071,512

[45] Date of Patent: Dec. 10, 1991

[54] PAPER MAKING USING HECTORITE AND CATIONIC STARCH

[75] Inventors: Harris J. Bixler, Belfast; Stephen Peats, Camden, both of Me.

[73] Assignee: Delta Chemicals, Inc., Searsport, Me.

[21] Appl. No.: 211,550

[22] Filed: Jun. 24, 1988

[51] Int. Cl.[5] ..... D21H 17/29; D21H 17/68

[52] U.S. Cl. ..... 162/175; 162/181.8; 162/183

[58] Field of Search ..... 162/175, 181.6, 181.5, 162/183

[56] References Cited

U.S. PATENT DOCUMENTS 4,749,444 6/1988 Lorz et al. ..... 162/181.8

4,753,710 6/1988 Langley et al. ..... 162/181.8

*Primary Examiner*—Peter Chin

*Attorney, Agent, or Firm*—Ladas & Parry

[57] ABSTRACT

Addition of hectorite and a cationic starch to the furnish in a paper making operation improves the retention of filler material and the quality of the paper.

13 Claims, 8 Drawing Sheets

Figure 1:
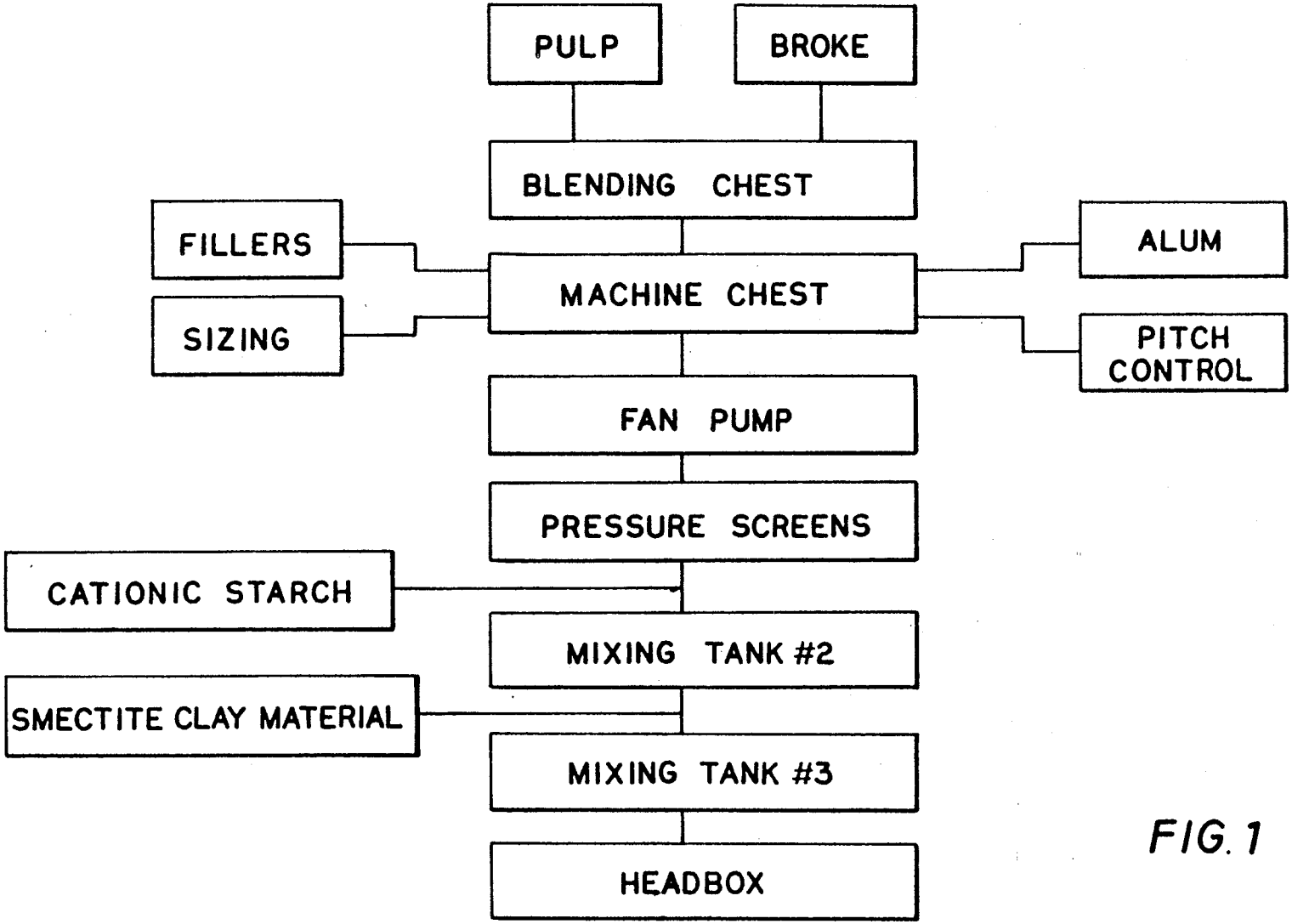

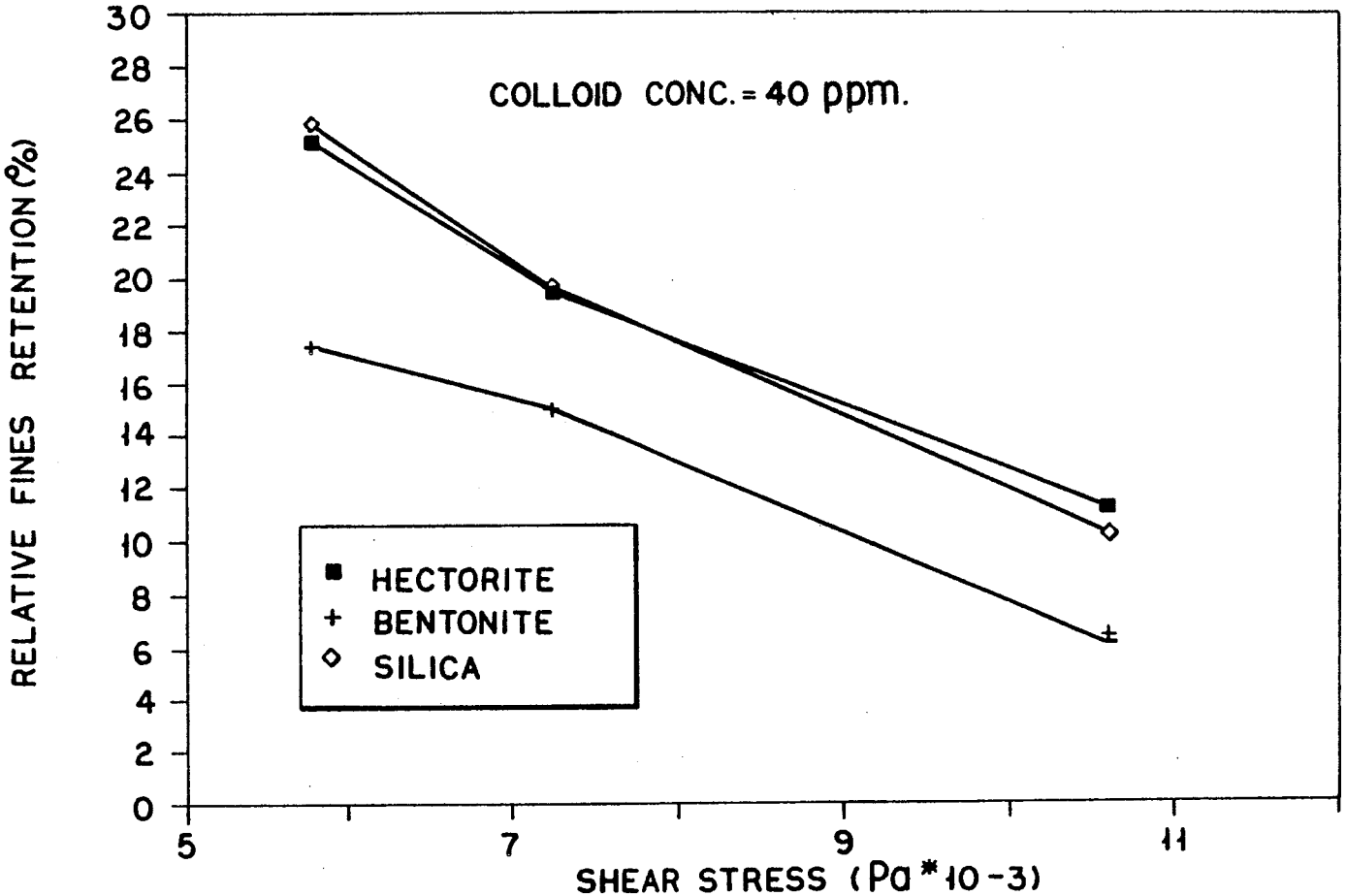
FIG. 2 EFFECT OF SHEAR STRESS ON RELATIVE FINES RETENTION - UTILIZING BRITT JAR

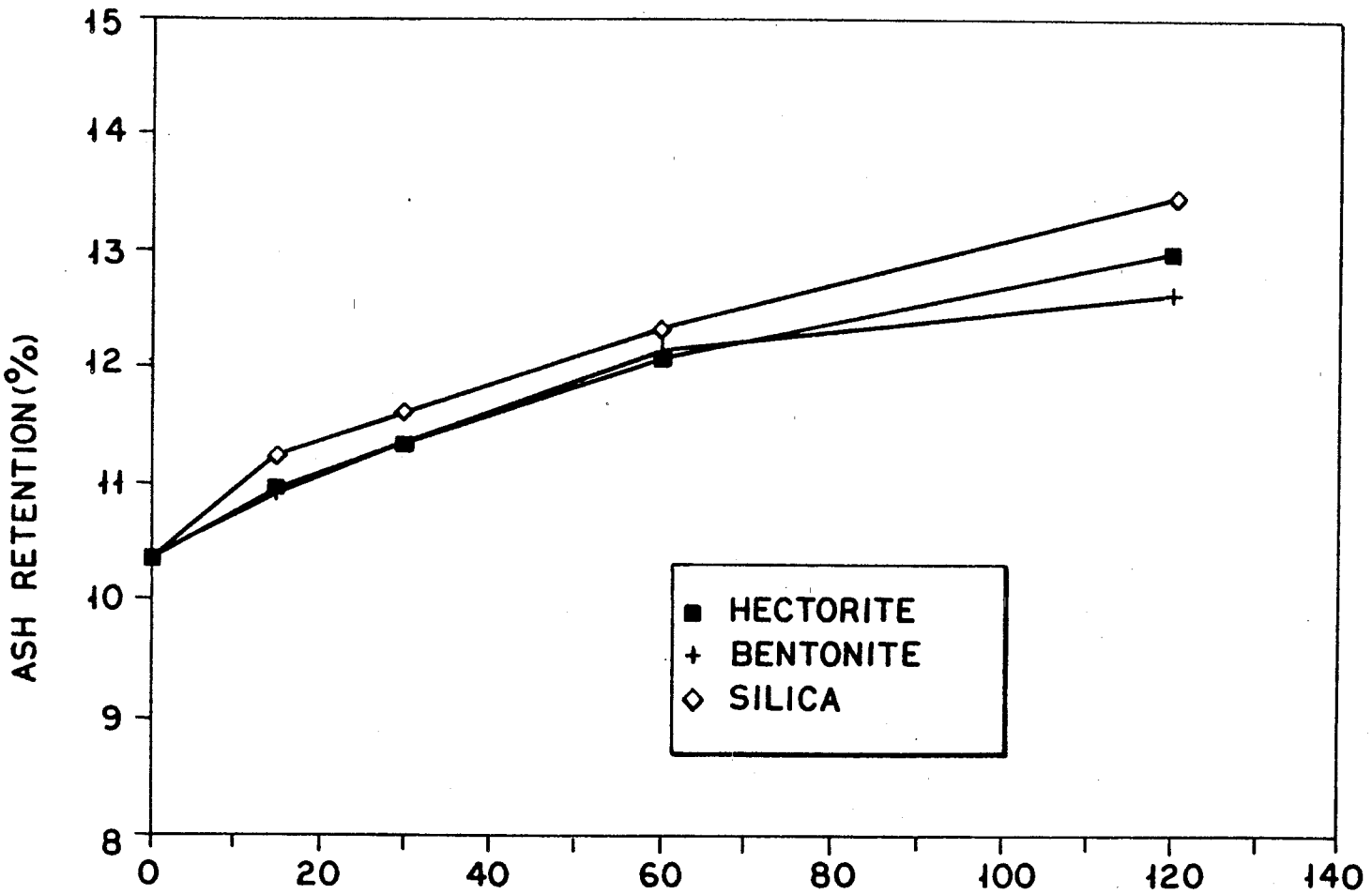
FIG. 3 EFFECT OF VARIOUS ANIONIC COLLOIDS ON ASH RETENTION

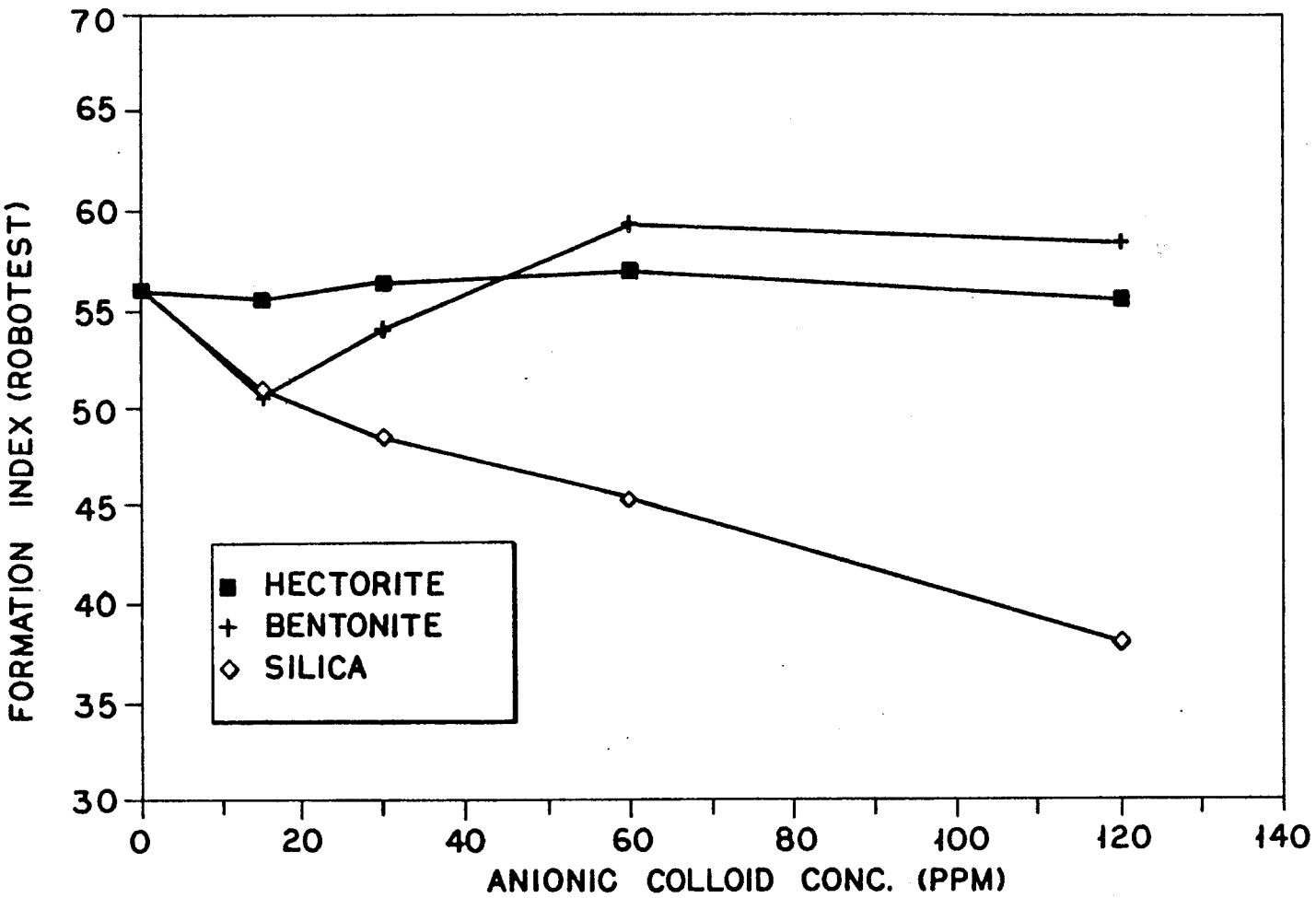
FIG. 4 EFFECT OF VARIOUS ANIONIC COLLOIDS ON FORMATION INDEX

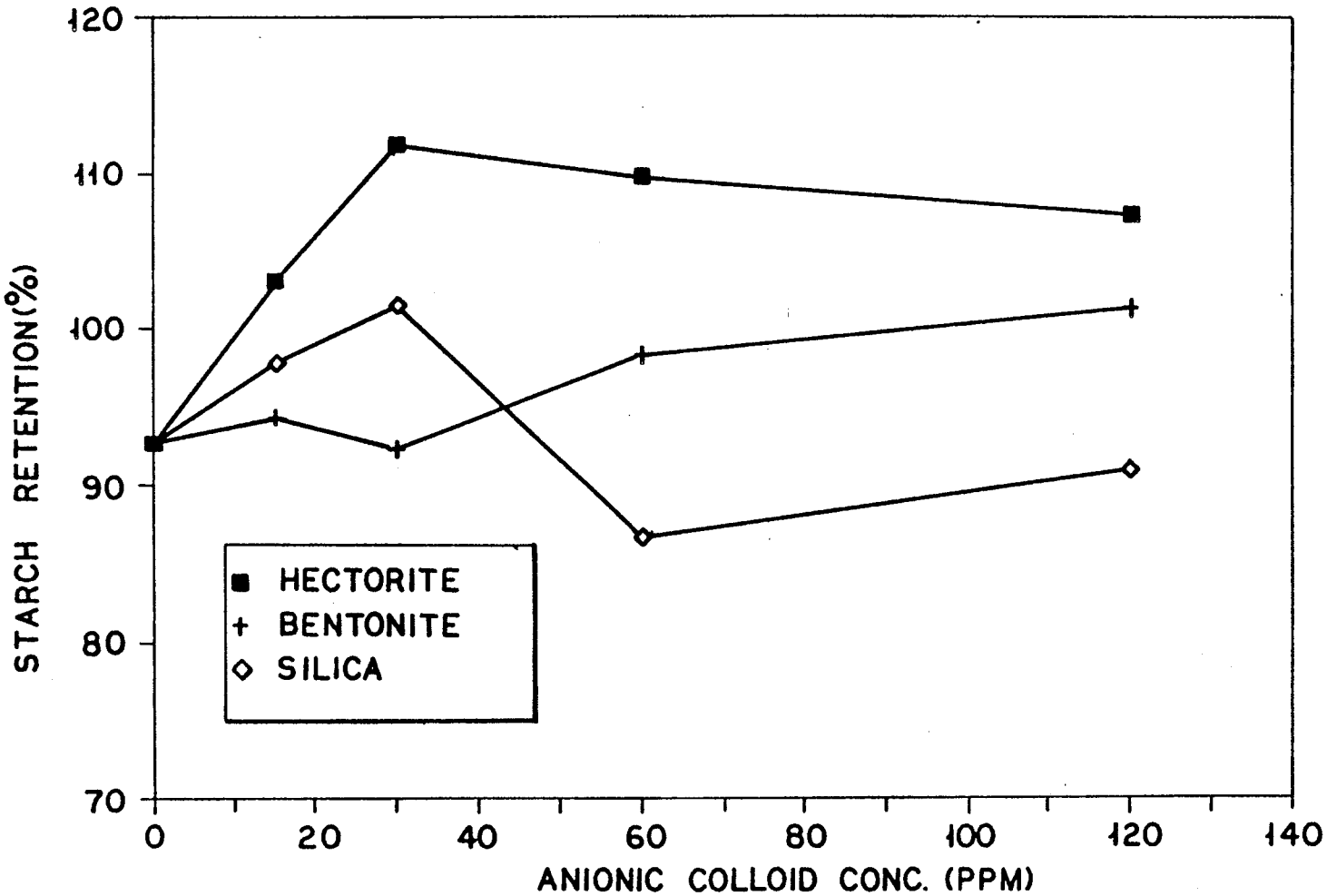
FIG. 5 EFFECT OF VARIOUS ANIONIC COLLOIDS ON STARCH RETENTION

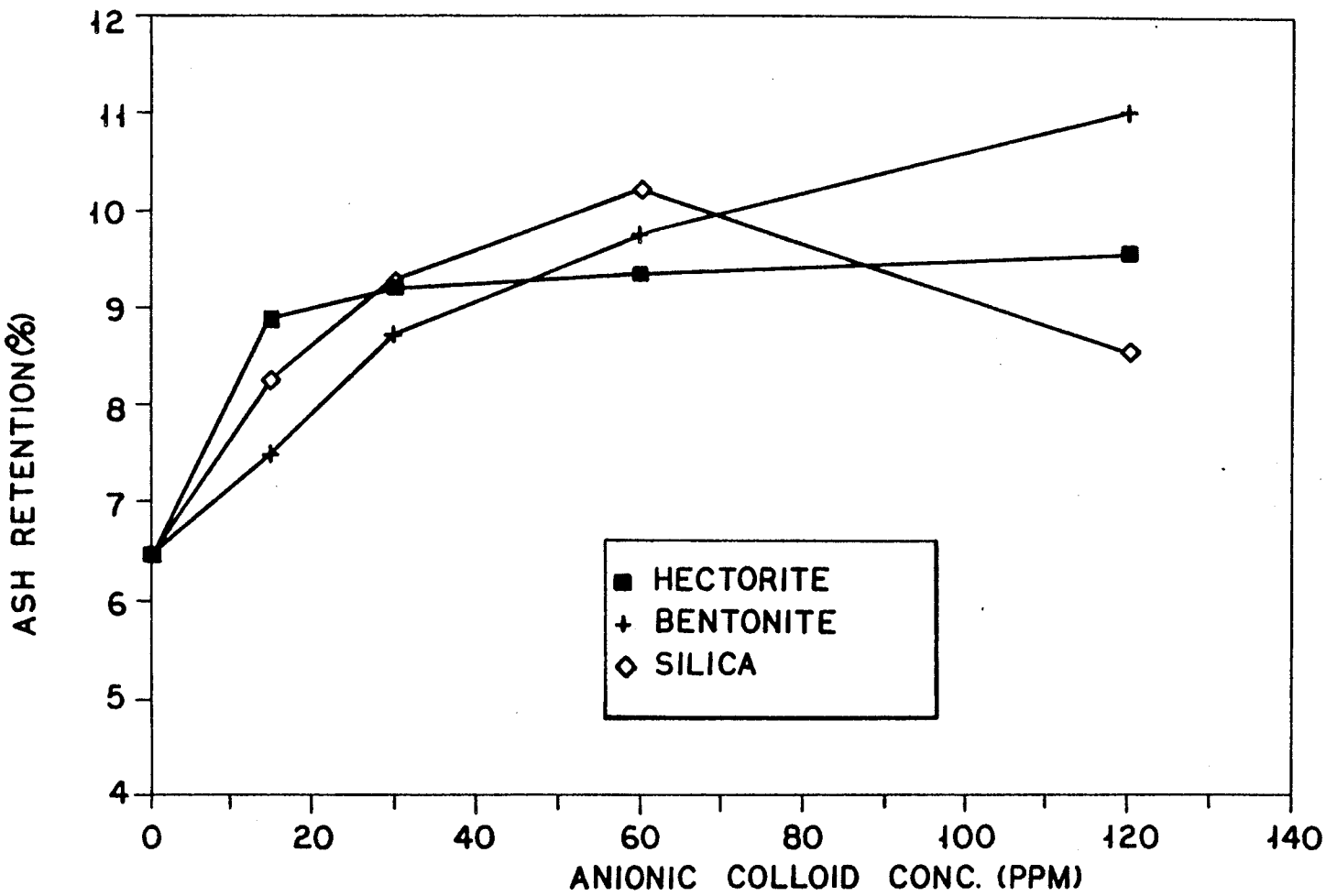
FIG. 6 EFFECT OF VARIOUS ANIONIC COLLOIDS ON ASH RETENTION

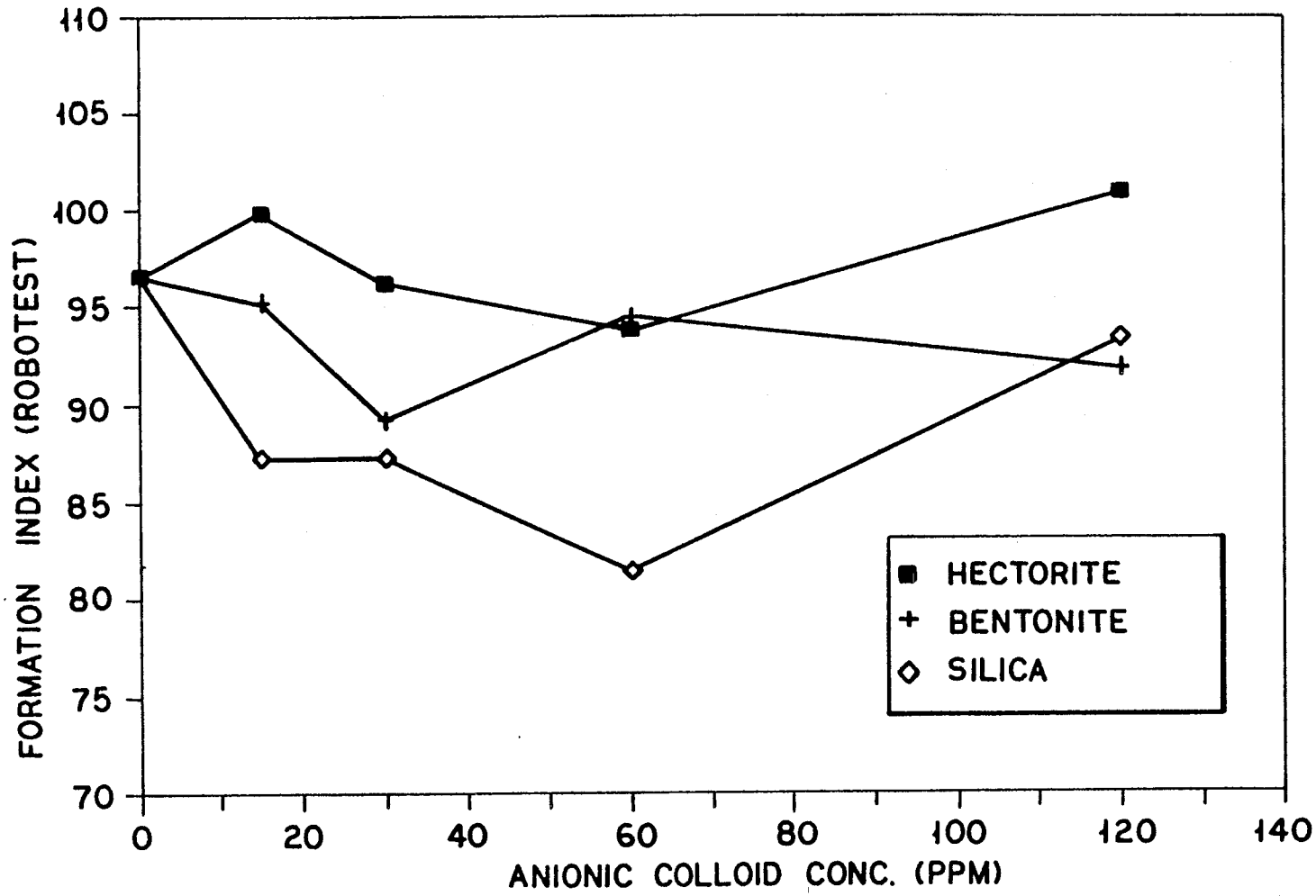
FIG. 7 EFFECT OF VARIOUS ANIONIC COLLOIDS ON FORMATION INDEX

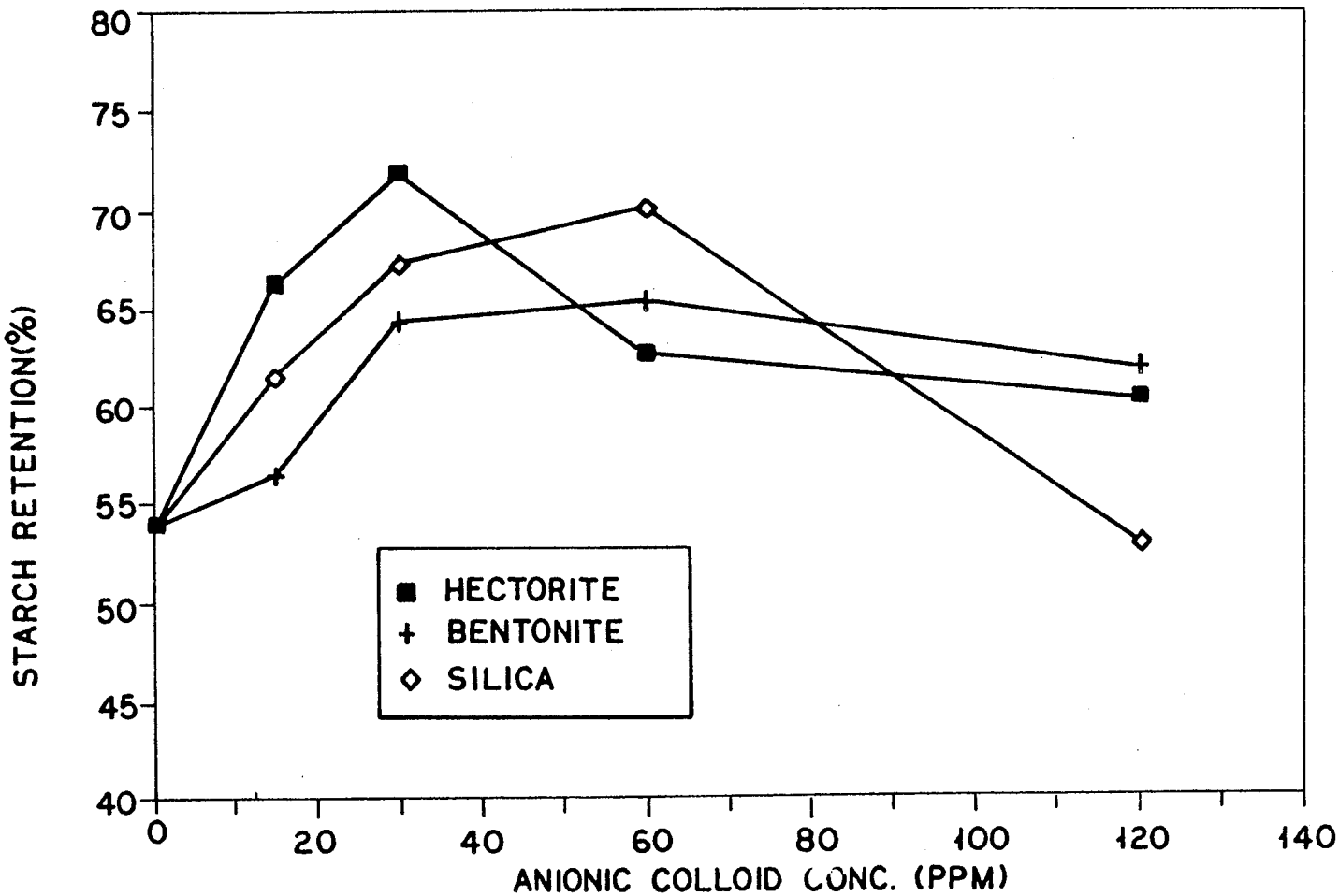
FIG. 8 EFFECT OF VARIOUS ANIONIC COLLOIDS ON STARCH RETENTION

PAPER MAKING USING HECTORITE AND CATIONIC STARCH

The present invention relates to paper making. In particular, it relates to a multi-component system for improving wet-end chemistry in paper making.

In order to try to reduce the cost of paper and modify certain paper properties expedients have been tried. Among these have been attempts to replace cellulosic fibers by filler materials such as kaolin clays. It has, however, proved to be difficult to maintain satisfactory quality, especially as the ratio of filler to fiber is increased.

One attempt to improve the quality of paper in which filler is used is described in U.S. Pat. No. 4,388,150 and its companion U.S. Pat. No. 4,385,961. These are in the names of Sunder et al and Svending et al respectively and are assigned to EKA Aktiebolag of Surte, Sweden. U.S. Pat. No. 4,388,150 describes the use of a binder complex containing colloidal silicic acid and cationic starch. The use of such a binder composition is said to enhance the strength of paper produced and also to improve the retention of fillers such as kaolin, bentonite, titanium dioxide, chalk or talc if these are present. A multi-component binder comprising colloidal silicic acid and cationic starch is marketed in the United States under the trademark Compozil by Procomp of Marietta, Georgia, a joint venture of DuPont and EKA AB.

U.S. Pat. No. 2,795,545 (Gluesenkamp, assigned to Monsanto Chemical Company) describes the use of synthetic cationic polymers in conjunction with inorganic materials such as those having a high base exchange capacity for example, bentonite, hectorite, beidellite, nontronite or saponite, for use in a wide variety of applications including reinforcement of rubbers and to improve retention of clays when used as beater additives in paper making. U.S. Pat. No. 4,643,801 (Johnson, assigned to Nalco Chemical Company) describes a binder comprising a cationic starch, a high molecular weight anionic polymer and a dispersed silica.

U.S. Pat. No. 4,210,490 describes the use of kaolinitic clay filler together with cationic starch in the production of paper or cardboard.

The use of cationic starch in conjunction with colloidal silica for various purposes is described in U.S. Pat. Nos. 3,253,978 (Bodendorf), 3,224,927 (Brown) and 3,647,684 (Malcolm).

It is an object of the present invention to provide a binder for use in paper making.

Accordingly, from one aspect the present invention provides the use of a binder comprising a cationic starch and a smectite clay material in paper making.

From a second aspect the invention provides a binder composition comprising a cationic starch and a smectite clay material.

The smectite clay material utilized in this invention may be any member of the dioctahedral or trioctahedral smectite group or mixtures thereof. Examples are beidellite, nontronite, and hectorite from the trioctahedral group and saponite, and bentonite from the dioctahedral group. When used herein the term "smectite"0 includes not only naturally occurring clays but also synthetic or semi-synthetic equivalents thereof. The preferred smectite clay materials are hectorite from the trioctahedral group and bentonite from the dioctahedral group. Hectorite is particularly preferred. These clay materials, to be effectively water swellable and dispersable must possess monovalent cations, preferably sodium, as the predominant exchangeable cation. However, the smectite clay materials may also contain other multivalent exchangeable cations such as calcium, magnesium and iron.

As noted above bentonite has been used previously in some applications in paper making, for example, as a filler, to control pitch deposition and also for imparting viscosity to paper coating preparations. Such uses are, however, different from the use of bentonite in the present invention in that bentonite to control pitch is added to the wood fiber pulp much further back in the papermaking process than in the present invention and when used in a coating is added much later in the papermaking process (after the sheet is dried) than in the present invention.

Smectite clay materials are characterized by their relatively high cation-exchange capacities. Kaolin and talc clay material used as fillers in paper making on the other hand have low cation-exchange capacity. The smectite clay materials have exchange capacities in the range 80–150 milliequivalents per 100 g, whereas kaolin and talc exchange capacities are 3–5 milliequivalents per 100 g or less. It is this high anionic charge density that is essential for the smectite clay material to be effective in this binder.

Naturally occurring smectite clay material that possess a predominant amount of exchangeable divalent cation such as calcium can be converted, in a post-mining process, from a non-swelling to a swelling form. One process for carrying out this ion exchange is called "peptizing" and is well known in the clay processing industry. It exchanges a monovalent cation such as sodium for the calcium ions. Such peptized clays may be used in the present invention.

When used in the present invention the peptized smectite clay material is dispersed and swollen in an aqueous solution where it assumes a sol structure of individual plate-like particles or small aggregates of particles. The thickness of the individual plates is from 100–500nm and the surface dimensions are typically 2500–5000nm. It is necessary that the individual clay particles possess dimensions of this order of magnitude so that they are truly colloidal in behavior. The preparation of the smectite clay material sols for use in this invention must be performed in such a way as to assure that a large percentage of individual platelets are present in the binder.

Cationic starches for use in the present invention are typically those with a relatively high degree of substitution (D.S.), typically greater than 0.03. When using potato starch we have found it particularly useful to employ starches having a degree of substitution in the range 0.035 to 0.05, preferably 0.04–0.046. Suitable substituents include tertiary and quaternary amine groups. We have found that cationic potato starch is particularly useful although cationic starches derived from other sources, for example, waxy maize starch, corn starch, wheat starch and rice starch may also be of use. We believe that in general high molecular weight starches such as potato starch are preferable to those of lower molecular weight. Typical of other paper making uses of starch the cationic starch for use in the present invention must be "cooked" or pasted in water to swell and partially dissolve the starch molecules before using it in the binder.

We believe that in general that a starch which shows a high peak viscosity in a Braebender Amylograph is preferred to one with a low peak viscosity and that one with a low pasting temperature is preferred to one with a high pasting temperature. Without wishing to be bound by any theory, we believe these properties relate to the ease of dissolving and dispersing the starch molecules in the furnish and preserving their high molecular weight at the point of use.

Although the binder of the present invention may be used in paper making in the absence of a filler, it will frequently be employed in conjunction with fillers, such as, kaolin, calcium carbonate, talc, titanium dioxide, barium sulfate or calcium sulfate. When fillers are present they may be used in amounts 50 to 500 lbs/ton dry weight. Commonly, filler in present in the range 200 to 300 lbs/ton dry weight. It will also frequently be employed in conjunction with sizing agents, colorants, optical brighteners and other minor ingredients of commercial papermaking furnishes.

The starch and the smectite clay material are typically employed in ratios of from 0.25:1 to 15:1 preferably in the range 1:1 to 8:1, more preferably in the range 1.5:1 to 6:1. Typically, these materials will be added in amounts to produce a concentration in the paper stock of smectite clay material in the range 2–60 lbs/ton dry base sheet, preferentially, in the range 5–40 lbs/ton dry base sheet.

Typically, the starch will be employed as a cooked slurry, for example at a concentration of 0.25 to 2.5 weight percent, preferably 0.75 to 1.25. Typically the smectic clay material will be employed as a peptized sol, for example, at a concentration of 0.1 to 2.0 weight percent, preferably 0.3 to 0.6.

The binder of the present invention can be used with a variety of paper making furnishes including those based on chemical, thermomechanical and mechanical treated pulps from both hard and softwood sources.

The binder of the present invention is added to the paper making stock after other furnish ingredients have been added but prior to its introduction to the paper making machine headbox. The binder must be formed in situ in the stock by adding the smectite clay material and the cationic starch separately with adequate mixing between additions.

A flow diagram of a typical paper machine in which the present invention may be used is shown in FIG. 1. We have found that the preferred location and order of adding the binder components to the paper stock is that shown in the figure although reversal of the order of addition of starch and smectite is possible. The furnish components are mixed in tank 1 after which cationic starch is added and the resultant mixture transferred to tank No. 2 where it is again thoroughly mixed. The smectite clay material sol is then added and the final furnish is mixed in tank 3 prior to introduction into the headbox of the paper making machine. We have found that it is not beneficial to subject the furnish containing starch to excessively high shear stress prior to the addition of the smectite clay material. Furthermore, it is not beneficial to submit the furnish containing both the starch and smectite clay material to excessively high shear stress. Thus, shear stresses greater than 6,000 Pa should be avoided at these stages. In a practical sense this means that it is desirable that additions of the binder are made after both the fan pumps and pressure screens as shear stresses of 20,000 Pa and 10,000 Pa, respectively, are experienced at these stages.

We have found that when using the binder of the present invention, it may be possible to increase the retention of fines or ash and starch in paper compared to using cationic starch by itself as a binder. Without wishing to be bound by any theory, we believe this improvements results from the cationic starch and smectite clay material interacting with the fines to bind them more effectively to fibers and filler particles than can the cationic starch by itself.

We have further found that when using the binder of the present invention it may be possible to improve formation at higher fines retention in paper compared to using the colloidal silica of U.S. Pat. No. 4,388,150. Without wishing to be bound by any theory, we believe that these improvements are due in part to the size and shape of the smectite clay materials as compared to silica.

The present invention will now be illustrated by the following Examples in which all parts are given by weight. The silica used in the comparative tests had a particle size of about 6 nm and a surface area of about 500 m/g.

EXAMPLE 1

The effect of separate additions of starch and various anionic colloids on fines retention in an acid furnish containing chemical, thermochemical and ground wood pulp was investigated using a Britt dynamic drainage jar. The colloid was added prior to the starch. Two different starches were employed: a cationic potato starch having a degree of substitution of 0.04 and an amphoteric corn starch.

The results obtained were as follows:

| Anionic colloid (20 ppm) | % Fines Retention | |
|---|---|---|
| | Cationic potato starch (40 ppm) | Amphoteric corn starch (40 ppm) |
| none | 32.4 | 28.9 |
| hectorite | 38.1 | 25.8 |
| bentonite | 32.0 | 25.8 |
| silica | 39.1 | 27.2 |

From this it appears that the use of hectorite and silica when combined with cationic potato starch convey a benefit over the use of cationic starch alone. This does not appear to be true for amphoteric corn starch.

EXAMPLE 2

The procedure of Example 1 was repeated using cationic potato starch (40 ppm) but reversing the order of addition. The results were as follows:

| Anionic colloid (20 ppm) | % Fines retention |
|---|---|
| None | 34.9 |
| hectorite | 43.4 |
| bentonite | 36.5 |
| silica | 44.8 |

From this, it appears that there is a small incremental improvement in retention when the starch was added prior to the colloid.

EXAMPLE 3

The effect of shear after addition of the starch and prior to addition of the anionic colloid on the retention of fines using the same furnish as employed in Example 1 was investigated in a Britt dynamic drainage jar using the same cationic potato starch that was employed in the previous two Examples. The starch was present at a concentration of 40 ppm. The results obtained were as follows:

| Anionic Colloid (20 ppm) | % fines retention with high shear (6000 Pa) | with low shear (600 Pa) |
|---|---|---|
| None | — | 35.2 |
| hectorite | 36.3 | 47.1 |
| bentonite | 33.9 | 39.0 |
| silica | 34.4 | 42.3 |

From this, it appears that the substantially reduces the retention that can be achieved with all the anionic colloids when combined with cationic potato starch.

EXAMPLE 4

The effect of shear on the combined furnish-binder system was investigated using a furnish similar to that of Example 1. The various anionic colloids were used at a concentration of 20 ppm and the starch, as used in Example 1, was used at a concentration of 40 ppm. The relative fines retention was measured in a Britt dynamic drainage jar at various shear stresses. The results are shown in FIG. 2.

From this it appears that increasing shear stress progressively diminishes the efficacy of the binder system. Stresses less than 7,000 Pa, however, do not cause unacceptable losses in efficacy of the binder system.

EXAMPLE 5

The effect of using different post-mining procedures to convert hectorite obtained from the same deposit from a non-swellable to a swellable was tested in a similar way using the same potato starch as in Example 1. The results obtained were as follows:

| Anionic colloid | Colloid conc. (ppm) | Starch conc. (ppm) | % Fines retention |
|---|---|---|---|
| None | — | 0 | 23.5 |
| | — | 40 | 29.9 |
| Hectorite Procedure I | 20 | 40 | 37.8 |
| Hectorite Procedure II | 20 | 40 | 39.9 |
| Bentonite | 20 | 0 | 25.4 |
| | 20 | 40 | 32.4 |
| Silica | 20 | 0 | 24.9 |
| | 20 | 40 | 35.1 |

From this, it appears that substantially the same retention can be achieved with hectorite prepared by either procedure.

EXAMPLE 6

The effect of using hectorite obtained from different locations was tested in a similar way using the potato starch as in Example 1. The results obtained were as follows:

| Anionic colloid | Colloid conc. (ppm) | Starch conc. (ppm) | % Fines retention |
|---|---|---|---|
| None | — | 0 | 27.3 |
| | — | 40 | 34.3 |
| Hectorite I (Nevada) | 20 | 40 | 50.2 |

-continued

| Anionic colloid | Colloid conc. (ppm) | Starch conc. (ppm) | % Fines retention |
|---|---|---|---|
| Hectorite II (California) | 20 | 40 | 48.0 |
| Hectorite III (California) | 20 | 40 | 49.1 |

From this it appears that substantially the same retention can be achieved with hectorite mined from different deposits.

EXAMPLE 7

Hand sheets were prepared using a laboratory hand sheet former (a British Standard sheet mold). The starting material was a furnish consisting of 30% unbleached ground pulp, 50% kraft softwood and hardwood pulp and 20% thermochemical pulp to which had been added 15% (based on the weight of pulp) filler clay and 30 lbs/ton alum.

Cationic starch was added at a level of 120 ppm to all experiments except the blank. Various amounts of hectorite, bentonite and silica were added to give starch:colloid ratios varying from 1:8 to 1:1. The hand-sheets produced were tested for various parameters among them were ash, starch retention and formation (Robotest).

The results obtained are shown in FIGS. 3-5 of the accompanying drawings.

EXAMPLE 8

The tests referred to in Example 7 were repeated using a different furnish containing 75% Kraft hardwood and 25% Kraft softwood to which 15% clay (based on the amount of pulp) and 20 lbs/ton alum had been added. The results obtained are set out in FIGS. 6-8.

EXAMPLE 9

The effect of the source and type of starch employed and its degree of substitution was investigated in a Britt dynamic drainage jar. Using hectorite as the anionic colloid and the various starches at a concentration of 40 ppm. The results obtained were a follows:

| Starch Source | Manufacturers stated degree of substitution | Hectorite Conc. (ppm) | % Fines Retention | % Increase in Fines Retention when hectorite (%) present |
|---|---|---|---|---|
| Potato | 0.040 | 0 | 27.9 | 70 |
| Potato | 0.040 | 20 | 47.6 | |
| Potato | 0.023 | 0 | 20.8 | 36 |
| Potato | 0.023 | 20 | 28.2 | |
| Potato (Pregelatinized) | 0.040 | 0 | 23.5 | 71 |
| Potato (Pregelatinized) | 0.040 | 20 | 40.2 | |
| Potato | 0.030 | 0 | 18.4 | 23 |
| Potato | 0.030 | 20 | 22.6 | |
| Potato | 0.040 | 0 | 22.6 | 55 |
| Potato | 0.040 | 20 | 35.0 | |
| Potato | 0.046 | 0 | 29.8 | 67 |
| Potato | 0.046 | 20 | 49.9 | |
| Corn | 0.030 | 0 | 19.6 | 18 |
| Corn | 0.030 | 20 | 23.2 | |
| Waxy Maize | "Low" | 0 | 26.0 | 37 |
| Waxy Maize | "Low" | 20 | 35.7 | |
| Waxy Maize | "High" | 0 | 25.4 | 33 |

-continued

| Starch Source | Manufacturers stated degree of substitution | Hectorite Conc. (ppm) | % Fines Retention | % Increase in Fines Retention when hectorite (%) present |
|---|---|---|---|---|
| Waxy Maize | "High" | 20 | 33.7 | |

The two potato starches of nominal degrees of substitution of 0.04 were obtained from different manufacturers.

EXAMPLE 10

The effect of the method of addition of the starch and hectorite on fines retention was investigated using a Britt dynamic drainage jar. The starch was a potato starch having a degree of substitution of 0.04 and was employed at a concentration of 40 ppm. The hectorite was employed at a concentration of 20 ppm.

The results obtained were as follows:

| Reagents added | % Fines retention | Increase in Fines retention (%) |
|---|---|---|
| Starch Only | 26.91 | — |
| Starch Then Hectorite | 33.36 | 6.45 |
| Hectorite Then Starch | 33.78 | 6.87 |
| Starch + Hectorite Pre-Mixed | 22.73 | −4.18 |

From this, it appears that while reversing the order of starch and hectorite addition has negligible effect on retention improvement over starch addition only, premixing the starch and hectorite has a decided depressing effect on retention.

We claim:

1. A paper making process wherein a collodial sol of a hectorite and a cationic starch having a degree of substitution of at least 0.003 are added separately to a furnish to form a binder consisting essentially of these two materials in said furnish, the weight ratio of starch to hectorite being in the range 0.25:1 to 15:1 said hectorite being added in an amount to result in its presence in an amount of at least 2 lbs/ton dry base sheet.

2. A paper making process according to claim 1, wherein said hectorite has a particle size in the range 100–500 nm thickness and 2,500–5,000 nm in width.

3. A paper making process according to claim 1, wherein said cationic starch has a degree of substitution in the range 0.04 to 0.046.

4. A paper making process according to claim 1, wherein said cationic starch is potato starch.

5. A paper making process according to claim 1, wherein said cationic starch and said hectorite is employed in a weight ratio of 1:1 to 8:1.

6. A paper making process according to claim 1, wherein said ratio is in the range 1.5:1 to 6:1.

7. A paper making process according to claim 1, wherein said hectorite is present in an amount of 2 to 60 lbs/ton dry base sheet.

8. A paper making process according to claim 1, wherein filler is employed in the furnish in an amount of from 100 to 500 lbs/ton dry base sheet.

9. A paper making process according to claim 8, wherein said filler is selected from kaolin, calcium carbonate, talc, titanium dioxide, barium sulfate and calcium sulfate.

10. A paper making process according to claim 1, wherein the furnish and binder are subjected to shear, no greater than 6,000 Pa after addition of the binder.

11. A paper making process according to claim 1, wherein said hectorite and said cationic starch are added to the furnish separately.

12. A paper making process according to claim 8 wherein filler is employed in the furnish in an amount of from 200–300 lbs/ton.

13. A paper making process according to claim 8 wherein the hectorite employed is synthetic or semi-synthetic.

* * * * *

UNITED STATES PATENT AND TRADEMARK OFFICE

CERTIFICATE OF CORRECTION

PATENT NO. : 5,071,512

DATED : December 10, 1991

INVENTOR(S) : Harris J. Bixler, et. al.

It is certified that error appears in the above-identified patent and that said Letters Patent is hereby corrected as shown below:

Column 8, lines 4-6, cancel Claim 2.

Signed and Sealed this

Twenty-third Day of March, 1993

*Attest:*

STEPHEN G. KUNIN

*Attesting Officer*

*Acting Commissioner of Patents and Trademarks*